United States Patent [19]

Schröer et al.

[11] Patent Number: 4,614,546

[45] Date of Patent: Sep. 30, 1986

[54] SIZES BASED ON KETENE DIMERS

[75] Inventors: Wolf-Dieter Schröer, Leverkusen; Ulrich Beck, Bornheim; Peter Mummenhoff, Cologne; Heinz Bäumgen, Leverkusen, all of Fed. Rep. of Germany

[73] Assignee: Bayer Aktiengesellschaft, Leverkusen, Fed. Rep. of Germany

[21] Appl. No.: 738,640

[22] Filed: May 29, 1985

Related U.S. Application Data

[63] Continuation of Ser. No. 486,466, Apr. 19, 1983, abandoned.

[30] Foreign Application Priority Data

May 3, 1982 [DE] Fed. Rep. of Germany ..... 3216414

[51] Int. Cl.[4] ..... C08L 3/00

[52] U.S. Cl. ..... 106/213; 162/164.6; 102/212

[58] Field of Search ..... 162/164.6; 106/213, 106/210, 212; 524/102; 500/486, 466

[56] References Cited

U.S. PATENT DOCUMENTS

| | | | |
|---|---|---|---|
| 2,901,371 | 8/1959 | Arlt | 106/243 |
| 3,922,243 | 11/1975 | Aldrich et al. | 162/164.3 |
| 3,988,280 | 10/1976 | Aldrich et al. | 162/164.3 |
| 3,989,659 | 11/1976 | Aldrich et al. | 162/164.6 |
| 4,009,152 | 2/1977 | Mormann et al. | 528/73 |
| 4,243,481 | 1/1981 | Dumas | 162/164.6 |
| 4,279,794 | 7/1981 | Dumas | 524/112 |

FOREIGN PATENT DOCUMENTS

| | | |
|---|---|---|
| 903416 | 8/1962 | United Kingdom . |
| 1172898 | 12/1969 | United Kingdom . |
| 1461123 | 1/1977 | United Kingdom . |
| 1461124 | 1/1977 | United Kingdom . |

*Primary Examiner*—Theodore Morris

*Attorney, Agent, or Firm*—Sprung Horn Kramer & Woods

[57] ABSTRACT

New aqueous sizes, in particular paper sizes, are made available which contain (a) ketene dimers of the formula

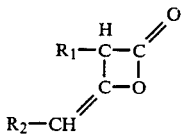

(I)

in which $R_1$ and $R_2$ can be identical or different and represent hydrocarbon radicals having 6 to 30 carbon atoms, (b) amine-modified starch, (c) hydrophobic compound(s) which contain(s) one or more functional groups which are reactive towards OH groups within a pH range of 2 to 6, and (d) if desired further auxiliaries.

8 Claims, No Drawings

SIZES BASED ON KETENE DIMERS

This is a continuation of application Ser. No. 486,466, filed 4/19/83, now abandoned.

The present invention relates to aqueous sizes based on ketene dimers, amine-modified starch, and, if desired, further auxiliaries.

A serious disadvantage of ketene dimer emulsions of the type described in German Patent Specification 1,148,130—they contain ketene dimers and amine-modified starch—is that to obtain useful sizing action a fixing agent must also be used. A further disadvantage of sizing with ketene dimer emulsions is that full sizing action only develops in the drying stage of the paper machine when a large amount of energy is consumed in drying.

It was therefore the object of the invention to prepare more effective and, if possible, less problematical utilisable sizes based on ketene dimers.

The object is achieved by adding a small amount of hydrophobic compounds which contain a functional group which is reactive towards OH groups within a pH range of 2 to 6, to the ketene dimer (I) before emulsification.

The invention relates to aqueous sizes based on (a) ketene dimers of the formula

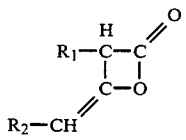

(I)

in which $R_1$ and $R_2$ can be identical or different and represent hydrocarbon radicals having 6 to 30 carbon atoms, (b) amine-modified starch, and (c) if desired further auxiliaries, characterised in that hydrophobic compound(s) which contain one or more functional groups which are reactive towards OH groups within a pH range of 2 to 6 are added to the ketene dimer, preferably 0.1 to 1.0 mol of reactive functional groups being used per 1,000 parts by weight of ketene dimer (I).

The invention also relates to a process for preparing the size formulations, characterised in that the hydrophobic compound is added to the melt of the ketene dimer, and the resulting mixture, which, if desired, can also contain surface-active materials (such as, for example, emulsifiers and dispersants) and further auxiliaries, is added to an aqueous, preferably 1-12% strength solution of an amine-modified starch. Aqueous dispersions or emulsions are preferably prepared.

The invention further relates to the use of the above-mentioned sizes for sizing paper, in particular for pulp-sizing paper.

The substituents $R_1$ and $R_2$ of the formula (I) represent saturated, unsaturated and/or cyclic hydrocarbon radicals, for example alkyl, alkenyl, aralkyl, alkylaryl or alkylcycloalkyl groups.

Technically interesting ketene dimers are obtained from fatty acids having 12 to 22, in particular 14 to 20, carbon atoms. Particularly suitable are technical fatty acid mixtures, such as technical stearic acid, which contain as main components stearic acid and palmitic acid, and fatty acid mixtures which are derived from naturally occurring fats, for example coconut oil, babassu oil, palm kernel oil, palm oil, olive oil, peanut oil, rapeseed oil, beef tallow, lard, or whale fat. The ketene dimers are prepared from the fatty acids via the fatty acid chlorides derived therefrom, which, in conjunction with tertiary amines, can eliminate hydrogen chloride to give the ketene dimers.

Further examples of ketene dimers which can be used in preparing sizes according to the invention are the phenylketene dimer, the benzylketene dimer and the decylketene dimer.

Suitable compounds for use as hydrophobic compounds containing groups which are reactive towards OH groups within a pH range of 2 to 6 are those which are composed of a hydrophobic part and one or more functional groups.

Possible hydrophobic radicals—which carry the. reactive groups—are alkyl, alkenyl, cycloalkyl, aryl, aralkyl or alkylaryl groups.

Functional groups which can react with OH groups under the conditions mentioned are acid halides, acid anhydrides, imidoyl halides, isocyanates, or carbamoyl halides, of which acid halides, carboxylic acid anhydrides and isocyanates are preferred.

Also suitable for use as hydrophobic compounds reactive towards OH groups are compounds which can themselves be used for sizing. However, the sizing action obtained by means of the formulations according to the invention is greater than the sum of the sizing actions of the individual constituents.

Acid anhydrides which are preferably used embrace colophony anhydride (U.S. Pat. No. 3,582,464), anhydrides of the structure $$R_3—CO—O—CO—R_4$$

wherein $R_3$ and $R_4$ are straight-chain or branched alkyl, alkenyl, aralkyl or alkylaryl radicals having more than about 14 carbon atoms, and anhydrides of the structure $$R_6—R_5—CO—O—CO$$

wherein $R_5$ is a dimethylene or trimethylene radical, and $R_6$ is a radical from the group comprising alkyl, alkenyl, aralkyl and aralkenyl radicals having more than 7 carbon atoms, for example substituted cyclic dicarboxylic anhydrides such as succinic anhydrjde or glutaric anhydride (German Offenlegungsschrift 2,710,071) and oligomers of maleic anhydride and polymerisable olefines (German Offenlegungsschriften 2,947,174 and 2,804,202, and U.S. Pat. No. 3,244,767).

Examples of customary isocyanates (German Offenlegungsschrift 2,710,061) are those which contain hydrocarbon radicals having at least 12 carbon atoms, for example 14 to 36 carbon atoms, such as colophony isocyanates, hexadecyl isocyanate, octadecyl isocyanate, and 6-phenyldecyl isocyanate (German Offenlegungsschrift 2,710,061).

Also suitable are diisocyanates, such as, for example, hexamethylene diisocyanate, 2,2,3-trimethyl-1,6-diisocyanatohexane, 2,4,4-trimethyl-1,6-diisocyanatohexane, 1,4-diisocyanatocyclohexane, 5-isocyanato-1-isocyanatomethyl-1,3,3-trimethylcyclohexane, bis-(4-isocyanatocyclohexyl)-methane, 1,3-diisocyanatobenzene, 1,4-diisocyanatobenzene, toluylene-2,4-diisocyanate, toluylene-2,6-diisocyanate, 1,3-bisisocyanatomethylbenzene, 1,4-bisisocyanatomethylbenzene, bis-(4-isocyanatophenyl)-methane, 2,2-bis-(4-isocyanatophenyl)-propane, or mixtures thereof. Colophony isocyanate, hexadecyl isocyanate and octadecyl isocyanate are preferred.

Suitable acid halides are derived from saturated or unsaturated fatty acids having 12 to 30 carbon atoms, such as dodecanoyl chloride, dodecanoyl bromide, tetradecanoyl chloride, tetradecanoyl bromide, hexadecanoyl chloride, hexadecanoyl bromide, octadecanoyl chloride, octadecanoyl bromide, oleoyl chloride, oleoyl bromide or arachoyl chloride, and can also be used mixed.

Also suitable are dicarbonoyl dihalides which are derived from dicarboxylic acids having at least 8C atoms, such as, for example, suberoyl dichloride, suberoyl dibromide, azelaoyl dichloride, azelaoyl dibromide, trimethyladipoyl dichlorides, sebacoyl dichloride, sebacoyl dibromide, dodecanoyl dichloride, dodecanoyl dibromide, dimeric fatty acid dichlorides, dimeric fatty acid dibromides, or mixtures of these compounds.

Preferred acid halides are the acid chlorides, particularly suitable being hexadecanoyl chloride, octadecanoyl chloride, oleoyl chloride, and dimeric fatty acid dichlorides.

The hydrophobic compounds are admixed to the ketene dimers in such an amount that, should they have sizing action, they themselves fall short of significantly contributing to the sizing. The hydrophobic compounds added are capable of superadditively increasing the sizing action of the ketene dimers, like a synergism. The amount of hydrophobic compounds added depends on their molecular weight, since what matters is to admix to the ketene dimer a certain number of reactive groups. 0.1 to 1.0 mol of reactive groups is adequate per 1,000 parts by weight of ketene dimer. The amount used is preferably 0.2 to 0.7 mol of reactive groups per 1,000 parts by weight of ketene dimer.

For the purposes of the present invention, auxiliaries are understood as meaning, for example, surface-active materials (emulsifiers or dispersants), solvents, thickeners, biocides, for example fungicides, and antifoams.

The emulsions are prepared by, for example, emulsifying the melted mixture of ketene dimer (I) and of hydrophobic compound, to which about 5–35% of a liquid hydrocarbon, such as toluene, cyclohexane, octane or hydrocarbon mixtures, can be added, in an aqueous, 1 to 12% strength solution of an amine-modified starch at temperatures of 30° to 90° C., and the surface-active materials used can be, for example, anionic dispersants from the group comprising cresol/naphtholsulphonic acid/formaldehyde and phenol/bisulphite/urea condensates, non-ionic emulsifiers which are obtained by addition of ethylene oxide to compounds which contain hydroxyl groups and relatively long hydrocarbon radicals, such as saturated and unsaturated alcohols having 12 to 18 carbon atoms or alkylated phenols, or combinations of two or more of the surface-active materials mentioned. Anionic surface-active materials are preferred.

The amounts of the surface-active materials are chosen in such a way that formulations are obtained which are stable over a prolonged period. Formulations obtained in the reaction are diluted to the ketene dimer content desired (preferably 2 to 10% by weight). The stability of aqueous emulsions can be considerably increased by adjusting them to an acid pH value. As a rule a pH value of 2.0 to 5.5, preferably 3.0 to 4.5, is set by means of mineral acid or $C_1$–$C_4$-carboxylic acid.

Sizes according to the invention preferably contain 2 to 10% by weight of ketene dimer and 0.5 to 4% by weight of amine-modified starch (relative to the total weight of the size formulation). An example which may be mentioned of amine-modified starch is cationic potato starch.

Sizes according to the invention can also be used combined with fixing agents customary for this purpose. Possible fixing agents of this type are preferably wet-strength agents (for example based on polyamide-amine) or even polyacrylamides. In this connection see, for example, German Offenlegungsschrift 1,906,450 and German Offenlegungsschrift 1,720,905.

The invention is illustrated in more detail by the examples described below.

(A) Preparation of ketene dimer emulsions

A mixture of 300 g of cationic potato starch, 25 g of acetic acid, and 4,675 g of water was stirred at 90°–95° C. for 1 hour. The mixture was cooled down to 60° C., and 25 g of an anionic dispersant (cresol/naphtholsulphonic acid/formaldehyde condensate) and a hot melt, at 60° C., of 600 g of ketene dimer prepared from a mixture of palmitic acid and stearic acid, and a g of hydrophobic compound b were stirred in by means of a high-speed stirrer, and the mixture was passed twice under 200 bar of pressure through a Knollenberg homogeniser. The homogenised product was diluted with water down to a ketene dimer content of 6%, and cooled down to 30° C.

TABLE I

| Emulsion | a | b |
|---|---|---|
| 1 | 0 | Stearoyl chloride |
| 2 | 30 | Stearoyl chloride |
| 3 | 60 | Stearoyl chloride |
| 4 | 90 | Stearoyl chloride |
| 5 | 120 | Stearoyl chloride |
| 6 | 0 | Stearyl isocyanate |
| 7 | 30 | Stearyl isocyanate |
| 8 | 60 | Stearyl isocyanate |
| 9 | 90 | Stearyl isocyanate |
| 10 | 120 | Stearyl isocyanate |
| 11 | 20 | 2,4-Diisocyanato-1-methylbenzene |
| 12 | 35 | 2,4-Diisocyanato-1-methylbenzene |

(B) Test of sizing action

Sheets of paper were prepared on a laboratory sheet-former using the size emulsions. A 0.5% solids content pulp was prepared from 100 parts of wood pulp (50% of birch sulphate, 50% of pine sulphate) having a degree of freeness of 30° SR* and 25 parts of chalk, in water of about 20° dH**. a% of emulsion and then b% of fixing agent based on polyamide-amine (Nadavin LT®, Messrs. Bayer), relative to the pulp dry weight, were added. The sheets formed were wet-pressed down to a solids content of 30–35%, and then dried at 90°–93° C. on a steam-heated drum dryer for 4 minutes. The sheets of paper had a weight per unit area of 80 g/m$^2$. The $Cobb_{60}$ value (DIN 53,132) was determined to measure the sizing effect. The $Cobb_{60}$ value is a measure of the water absorption of the paper. A lower $Cobb_{60}$ value corresponds to a higher sizing action.

*Schopper-Riegler degree of freeness (expressed in °SR; method of measurement in accordance with DIN 54,360)

**°dH: degree of water hardness, given in degree of German hardness.

TABLE 2

| Emulsion | Cobb60 b = 0.5 a = 1.2 | b = 0.5 a = 1.4 | b = 0 a = 1.2 | b = 0 a = 1.4 | b = 0 a = 1.7 | b = 0 a = 2.0 |
|---|---|---|---|---|---|---|
| 1 | 91 | 85 | — | — | 62 | 49 |
| 2 | 34 | 24 | — | — | 23 | 18 |
| 3 | 36 | 26 | — | — | 22 | 18 |
| 4 | 32 | 21 | — | — | 19 | 19 |
| 5 | 34 | 22 | — | — | 20 | 18 |
| 6 | — | — | 51 | 34 | — | — |
| 7 | — | — | 39 | 23 | — | — |
| 8 | — | — | 39 | 22 | — | — |
| 9 | — | — | 38 | 23 | — | — |
| 10 | — | — | 39 | 24 | — | — |
| 11 | — | — | 42 | 24 | — | — |
| 12 | — | — | 36 | 22 | — | — |

(C) Preparation of ketene dimer from stearic acid/palmitic acid mixture 400 g of a fatty acid chloride mixture of 60 parts of stearoyl chloride and 40 parts of palmitoyl chloride were dissolved in 520 g of toluene which had been dried by distillation. A solution of 145 g of triethylamine in 240 g of dried toluene is added dropwise with stirring at 20° to 50° C., and the mixture is heated at 50° C. for two hours. 400 g of warm water, at 50° C., which contained 12 g of concentrated hydrochloric acid were then added at this temperature, and the mixture was stirred vigorously for 15 minutes.

The organic phase was carefully separated off at 50° C., and the solvent was completely distilled off in vacuo at a bath temperature of 50°-55° C. 337 to 345 g (yield: 96–98% of theory) of dimeric ketene, which crystallises on cooling, were obtained. Melting point = 52°-54° C.

We claim:

1. Aqueous sizes based on ketene dimers, which contain (a) ketene dimers of the formula

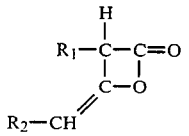

(I)

in which $R_1$ and $R_2$ are identical or different and represent hydrocarbon radicals having 6 to 30 carbon atoms, (b) amine-modified starch, (c) hydrophobic compound (s) which contain (s) one or more functional groups which are reactive towards OH groups within a pH range of 2 to 6 in an amount of 0.2 to 0.7 mol of reactive functional group per 1000 parts by weight of ketene dimer said hydrophobic compound (s) being selected from the group consisting of acid halides which are derived from fatty acids having 12 to 30 carbon atoms or isocyanates, which contain hydrocarbon radicals having 14 to 36 carbon atoms.

2. Sizes according to claim 1, characterised in that 0.2 to 0.7 mol of reactive functional group is used per 1,000 parts by weight of ketene dimer of the formula (I).

3. Sizes according to claims 1 or 2, characterised in that the further auxiliaries are surface-active materials and/or solvents and/or thickeners and/or biocides and/or antifoams.

4. Sizes according to claims 1, 2, or 3, characterised in that the hydrophobic compound contains as the hydrophobic molecular part alkyl, alkenyl, cycloalkyl, aryl, aralkyl or alkylaryl groups and as reactive groups isocyanate groups.

5. Sizes according to claims 1, 2, 3 or 4, characterised in that the hydrophobic compound is colophony isocyanate, hexadecyl isocyanate, octadecyl isocyanate or a mixture thereof.

6. Sizes according to claims 1, 2, 3 or 4, characterised in that the hydrophobic compound is hexamethylene diisocyanate, toluylene-2,4-diisocyanate, toluylene-2,6-diisocyanate, bis-(4-isocyanatophenyl)-methane, 2,2-bis-(4-isocyanatophenyl)-propane or a mixture thereof.

7. Sizes according to claims 1, 2, 3, 4 or 5, characterised in that the hydrophobic compound is hexadecanoyl chloride, octadecanoyl chloride, oleoyl chloride, or a mixture thereof.

8. Process for preparing the sizes according to claim 1, characterised in that the hydrophobic compound is admixed to a melt of the ketene dimer of the formula (I), and the mixture, which can also contain further auxiliaries, is added to an aqueous solution of an amine-modified starch.

* * * * *